United States Patent [19]

Dillon

[11] 4,444,231

[45] Apr. 24, 1984

[54] LOG SPLITTER FOR BACKHOE VEHICLES

[76] Inventor: Raymond L. Dillon, 8315 Joppa Rd., Huron, Ohio 44839

[21] Appl. No.: 334,475

[22] Filed: Dec. 28, 1981

[51] Int. Cl.[3] ..... B27L 7/00

[52] U.S. Cl. ..... 144/193 A; 144/193 R

[58] Field of Search ..... 144/193 R, 193 A, 3 K, 144/366, 193 K

[56] References Cited

U.S. PATENT DOCUMENTS

| | | | |
|---|---|---|---|
| 3,779,295 | 12/1973 | Balsbaugh | 144/193 A |
| 3,780,779 | 12/1973 | Guy | 144/193 A |
| 3,938,567 | 2/1976 | Dircksen et al. | 144/193 A |
| 4,073,325 | 2/1978 | Krom, Jr. | 144/193 A |
| 4,111,246 | 9/1978 | Lapointe | 144/193 A |
| 4,155,385 | 5/1979 | Lapointe | 144/193 A |

*Primary Examiner*—W. D. Bray

[57] ABSTRACT

This log splitting device is designed to be attached to a backhoe vehicle, in place of its digging bucket, which will enable the vehicle to be driven through the woods, brush or mud to split logs by the hydraulic components existing on the vehicle. Primarily, it consists of a base plate or platform, having an "I"-beam attached. The "I"-beam includes brackets for securing it to the beam of the vehicle, and a wedge member is slideable on the beam by an attached channel, so as to split a log on the base plate, and the hydraulic cylinder of the boom structure is used to apply hydraulic force to the wedge member, to split the log.

1 Claim, 5 Drawing Figures

LOG SPLITTER FOR BACKHOE VEHICLES

This invention relates to log working devices, and more particularly, to a log splitter for backhoe vehicles.

The principal object of this invention is to provide a log splitter for backhoe vehicles, which will be attached to the boom of the backhoe vehicle, in place of the existing digging bucket, so as to split logs easily in a minimum amount of time.

Another object of this invention is to provide a log splitter for backhoe vehicles, which will include a platform for placing the log that is to be split.

Another object of this invention is to provide a log splitter for backhoe vehicles, which will enable the user to drive anywhere, through woods, brush or mud, to cut and split wood quickly, and the split wood may easily be loaded into the front bucket of the backhoe vehicle, to be transported anywhere.

A further object of this invention is to provide a log splitter for backhoe vehicles, which will be safe in use.

Other objects of the present invention are to provide a log splitter for backhoe vehicles, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5:
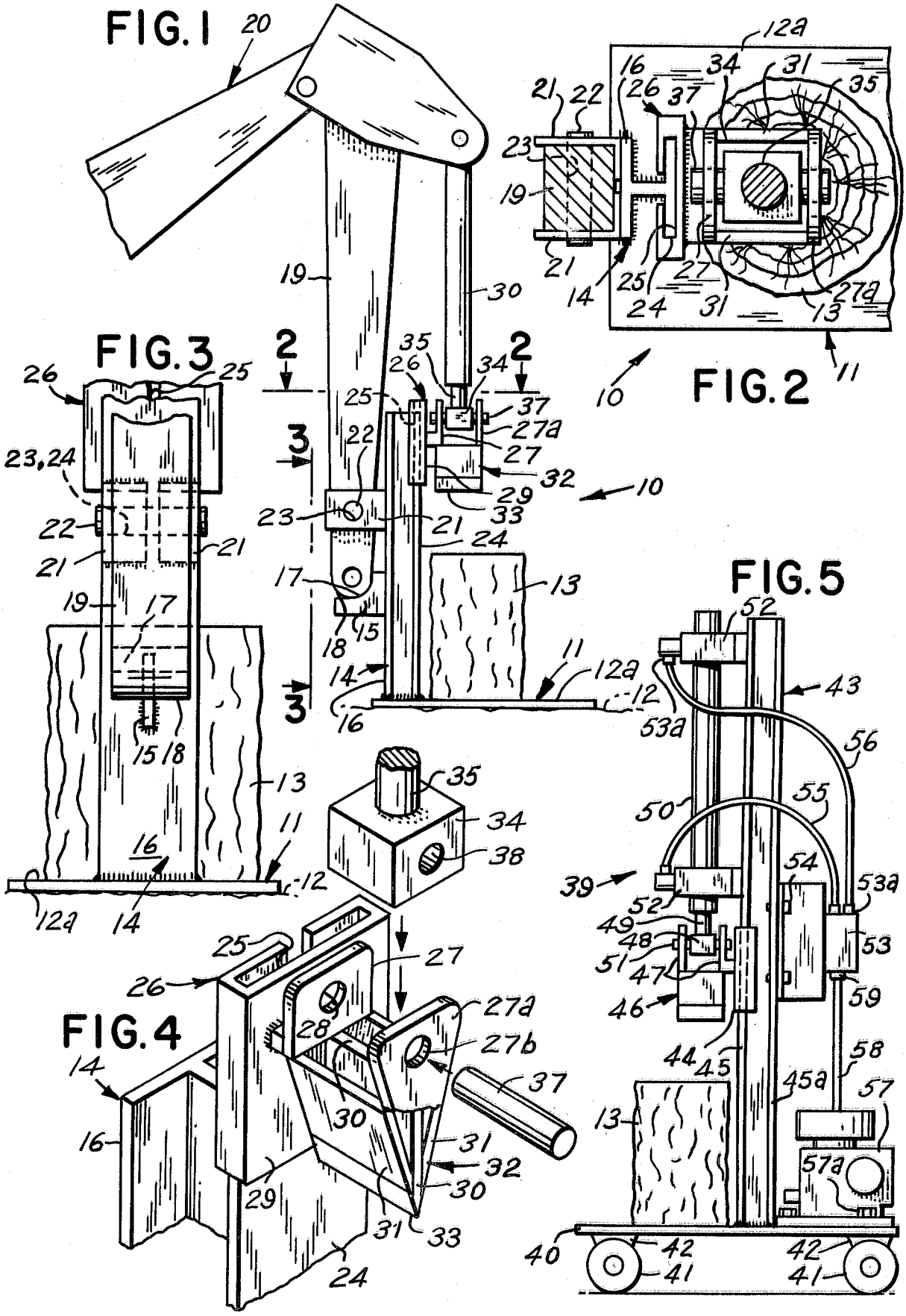
FIG. 1 is a side view of the present invention, shown secured to a backhoe vehicle, which is shown fragmentary.
FIG. 2 is an enlarged cross-sectional view, taken long the line 2—2 of FIG. 1.
FIG. 3 is an enlarged view, taken along the line 3—3 of FIG. 1.
FIG. 4 is an enlarged and exploded view of the wedge and piston ram, illustrating the wedge partly broken away and the ram shaft and guide rail fragmentary.
FIG. 5 is a side view of a modified form of the invention.

According to this invention, a log splitting device 10 is shown to include a base plate 11, which is placed upon the ground 12 for supporting a log 13, having its grain vertical to base plate 11, so as to be split by device 10. An "I"-beam 14 is fixedly secured at one end to the top 12*a* of base plate 11 by welding, and a plate bracket 15 is fixedly secured at one end to flange 16 by welding, and it includes an arcuate cutout 17 in its top end, for removably receiving the round end 18 of the boom 19 of backhoe vehicle 20. The bracket 15 functions as support means for boom 19, in conjunction with "I"-beam 14 and its attached base plate 11, when device 10 is in operation. A pair of parallel spaced-apart brackets 21 are fixedly secured at one of their ends to flange 16 of "I"-beam 14 by welding, and are spaced above plate bracket 15. Boom 19 is received between brackets 21, and a pin 22 is received in the openings 23 of brackets 21 and opening 24 of boom 20, so as to render boom 20 stationary with "I"-beam 14 and the attached base plate 11.

Flange 16 of "I"-beam 14 is freely and slideably received within a channel member 26. An "L"-shaped projection 27 is fixedly secured at its short side to face 29 of channel member 26 by welding, and is also fixedly secured by welding to the top edges of a vertical center plate 30 and a pair of angularly disposed side plates 31, which form wedge member 32 for splitting log 13. A second projection 27*a* is fixedly secured by welding to the tops of center plate 30 and side plates 31, and also includes an opening 27*b* therethrough, which aligns with opening 28 of projection 27, for a purpose, which hereinafter will be described. The vertical plate 30 is provided with a pointed end 33, so as to start the splitting of log 13 when force is applied thereto by hydraulic force means. The block member 34, which terminates the piston rod 35 of hydraulic cylinder 36 of backhoe vehicle 20, is received between the parallel spaced-apart projections 27 and 27*a* and pin 37 is received through openings 28 and 27*b* of projections 27 and 27*a*, and opening 38 through block 34, so as to lower and elevate wedge member 32 by hydraulic cylinder 36 of vehicle 20.

To employ the use of device 10, the pin 22 is removed from boom 19, and the pin 37 is removed from the block 36 of piston rod 35 of hydraulic cylinder 36, which releases the digging bucket from the backhoe vehicle 20. The base plate 11 is then placed into position with the boom 19 between brackets 21 and the rounded end 18 of the boom 19 resting in the cut-out 17 of plate bracket 15. The pin 22 is then placed into the openings 23 and 24, which renders the "I"-beam 14 of base plate 11 secure to boom 19. After the above has been accomplished, the channel member 26 is placed on the flange 16 of "I"-beam 14, and block member 34 is placed between projections 27 and 27*a*, with their respective openings 28, 27*b* and 38 aligned, after which, the pin 37 is placed therein, which completes the hook-up.

In operation, the log 13 is placed on the base plate or platform 11, with its grain vertical to the base plate 11 beneath the wedge member 32. The operator then actuates the hydraulic cylinder 36 in the usual manner, which will force wedge member 32 down and split the log 13. After splitting log 13, the operator raises the wedge member for another cycle of operation, and it shall be noted, that the channel 26, in combination with beam 14 and the boom 19, serves as positive guide means for the wedge member 32 when splitting log 13.

It shall also be noted, that device 10 can be attached to a backhoe boom 19 in minutes by one person, and device 10 may be attached to all of the different makes of backhoe vehicles, by simply changing the diameters of openings 23, 28, and 27*b* for different pin sizes, and changing the locations of plate bracket 15 and brackets 21, either up or down.

It shall further be noted, that there is no lifting of logs 13 whatsoever. A log 13 is simply rolled onto base plate 11 and stood on end to be split. The operator moves one lever on the controls of the backhoe vehicle 20 to operate device 10, and the base plate or platform 11 also keeps logs 13 out of mud or snow. Further, there is no necessity for lifting or holding onto a log, as is so with the horizontal log splitters, and the present invention supplies enough splitting power, at idle speed, to split a twenty-four inch diameter log, eighteen to twenty inches long.

Referring now to FIG. 5 of the drawing, a modified log-splitting device 39 is shown to include a platform 40, having a plurality of wheels 41 secured to wheel mounts 42, which are suitably fastened to the bottom of platform 40, in a manner not shown. An "I"-beam 43 is welded to the top of platform 40 at one end, and a channel member 44 is slideable on flange 45, similar to channel 26 of device 10. A wedge member 46 includes brackets 47, and is similar in construction to wedge member 32 of device 10, and the block member 48 of piston shaft 49 of hydraulic cylinder 50 is secured between brackets 47, by means of pin 51, which is also similar to block member 34 of device 10. A pair of cylinder mounting members 52 are spaced-apart and are welded or otherwise secured to flange 45, so as to hold hydraulic cylinder 50 firmly. A hydraulic pump and fluid reservoir combination 53 is secured to the opposite flange 45*a* of beam 43, by means of suitable fasteners 54, and hydraulic fluid lines 55 and 56 are secured to pump and reservoir combination 53, by common coupling 53*a* means. Lines 55 and 56 are also secured to hydraulic cylinder 50 by common coupling 53*a* means, so as to lower and raise wedge member 46 when splitting a log 13 by hydraulic force. A gasoline engine 57 is secured to the top of platform 40 by suitable fasteners 57*a*, and its drive shaft 58 is coupled to pump and reservoir combination 53, by coupling 59, so as to operate device 39.

In operation, log 13 is split by wedge member 46, in the same manner heretofore described of wedge member 32 of device 10, with the exception, that power is provided from the engine 57 mounted to platform 40, and the raising and lowering of wedge members 46 is controlled by the operator from control means common in the art and not shown.

While various changes may be made in the detail construction, it is understood that such changes will be within the spirit and scope of the present invention, as is defined by the appended claims.

What I now claim is:

1. A log splitter for backhoe vehicles, comprising, in combination, a horizontal base plate for standing up a log thereupon, a vertical "I" beam welded upon one end of said base plate, bracket means on a rear flange of said "I" beam for removable securement to a boom of said backhoe vehicle, a channel member being slidably fitted on a front flange of said "I" beam, an "L"-shaped projection welded on a face of said front flange, a wedge welded to an underside of said "L"-shaped projection, said wedge comprising a vertically positioned, flat, rectangular central plate sharpened along its lower edge, and an angularly inclined, upwardly diverging, flat, rectangular side plate abutted to each opposite flat side of said central plate, a triangular end plate affixed at one end of said wedge including an upwardly projection that is parallel to an upward portion of said "L"-shaped projection, and an aligned opening through said each projection receiving a removable pin therethrough and through a hole in a block on an end of a piston rod of an hydraulic cylinder carried on said boom.

* * * * *